US010752972B2

(12) United States Patent
Sugiura et al.

(10) Patent No.: US 10,752,972 B2
(45) Date of Patent: Aug. 25, 2020

(54) HOT-ROLLED STEEL SHEET

(71) Applicant: NIPPON STEEL & SUMITOMO METAL CORPORATION, Tokyo (JP)

(72) Inventors: Natsuko Sugiura, Kimitsu (JP); Mitsuru Yoshida, Himeji (JP); Hiroshi Shuto, Oita (JP); Tatsuo Yokoi, Oita (JP); Masayuki Wakita, Osaka (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/551,863

(22) PCT Filed: Feb. 22, 2016

(86) PCT No.: PCT/JP2016/055074
§ 371 (c)(1),
(2) Date: Aug. 17, 2017

(87) PCT Pub. No.: WO2016/136672
PCT Pub. Date: Sep. 1, 2016

(65) Prior Publication Data

US 2018/0037967 A1 Feb. 8, 2018

(30) Foreign Application Priority Data

Feb. 25, 2015 (WO) ..... PCT/JP2015/055464

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0205* (2013.01); *C21D 8/0226* (2013.01); *C22C 38/00* (2013.01);
(Continued)

(58) Field of Classification Search
None
See application file for complete search history.

(56) References Cited

U.S. PATENT DOCUMENTS 4,501,626 A 2/1985 Sudo et al.
6,251,198 B1 6/2001 Koo et al.
(Continued)

FOREIGN PATENT DOCUMENTS

CA 2882333 A1 4/2014
CA 2944863 A1 10/2015
(Continued)

OTHER PUBLICATIONS

Chinese Office Action and Search Report for counterpart Chinese Application No. 201680011657.5, dated Jun. 5, 2018, with English translation.
(Continued)

*Primary Examiner* — Anthony J Zimmer
*Assistant Examiner* — Ricardo D Morales
(74) *Attorney, Agent, or Firm* — Birch, Stewart, Kolasch & Birch, LLP

(57) ABSTRACT

A hot-rolled steel sheet includes a predetermined chemical composition, and a structure which includes, by area ratio, a ferrite in a range of 5% to 60% and a bainite in a range of 30% to 95%, in which in the structure, in a case where a boundary having an orientation difference of equal to or greater than 15° is defined as a grain boundary, and an area which is surrounded by the grain boundary and has an equivalent circle diameter of equal to or greater than 0.3 μm is defined as a grain, the ratio of the grains having an intragranular orientation difference in a range of 5° to 14° is, by area ratio, in a range of 20% to 100%.

4 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/26*** | (2006.01) |
| ***C22C 38/28*** | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C21D 2211/002* (2013.01); *C21D 2211/005* (2013.01)

(56) References Cited

U.S. PATENT DOCUMENTS

| | | | |
|---|---|---|---|
| 6,254,698 | B1 | 7/2001 | Koo et al. |
| 6,589,369 | B2 | 7/2003 | Yokoi et al. |
| 7,662,243 | B2 | 2/2010 | Yokoi et al. |
| 7,749,338 | B2 | 7/2010 | Yokoi et al. |
| 8,353,992 | B2 | 1/2013 | Sugiura et al. |
| 2002/0036035 | A1 | 3/2002 | Kashima et al. |
| 2003/0063996 | A1 | 4/2003 | Funakawa et al. |
| 2004/0074573 | A1 | 4/2004 | Funakawa et al. |
| 2005/0150580 | A1 | 7/2005 | Akamizu et al. |
| 2006/0081312 | A1 | 4/2006 | Yokoi et al. |
| 2006/0266445 | A1 | 11/2006 | Yokoi et al. |
| 2009/0050243 | A1* | 2/2009 | Satou ..... C22C 38/02 148/602 |
| 2009/0050244 | A1 | 2/2009 | Nakagawa et al. |
| 2009/0092514 | A1 | 4/2009 | Asahi et al. |
| 2010/0047617 | A1 | 2/2010 | Sugiura et al. |
| 2010/0108200 | A1 | 5/2010 | Futamura et al. |
| 2010/0108201 | A1 | 5/2010 | Yokoi et al. |
| 2010/0319819 | A1 | 12/2010 | Kaneko et al. |
| 2011/0017360 | A1 | 1/2011 | Yoshinaga et al. |
| 2011/0024004 | A1 | 2/2011 | Azuma et al. |
| 2011/0297281 | A1 | 12/2011 | Satou et al. |
| 2012/0012231 | A1 | 1/2012 | Murakami et al. |
| 2012/0018028 | A1 | 1/2012 | Shimamura et al. |
| 2012/0031528 | A1 | 2/2012 | Hayashi et al. |
| 2013/0000791 | A1* | 1/2013 | Takahashi ..... B21B 3/00 148/507 |
| 2013/0087254 | A1 | 4/2013 | Funakawa et al. |
| 2013/0276940 | A1 | 10/2013 | Nakajima et al. |
| 2013/0319582 | A1 | 12/2013 | Yokoi et al. |
| 2014/0000765 | A1 | 1/2014 | Nozaki et al. |
| 2014/0014236 | A1 | 1/2014 | Nozaki et al. |
| 2014/0014237 | A1 | 1/2014 | Yokoi et al. |
| 2014/0027022 | A1 | 1/2014 | Yokoi et al. |
| 2014/0087208 | A1 | 3/2014 | Toda et al. |
| 2014/0110022 | A1 | 4/2014 | Sano et al. |
| 2014/0255724 | A1 | 9/2014 | Yamanaka et al. |
| 2014/0287263 | A1 | 9/2014 | Kawata et al. |
| 2014/0290807 | A1 | 10/2014 | Goto et al. |
| 2015/0004433 | A1 | 1/2015 | Tanaka et al. |
| 2015/0030879 | A1 | 1/2015 | Kosaka et al. |
| 2015/0071812 | A1 | 3/2015 | Kawano et al. |
| 2015/0101717 | A1 | 4/2015 | Kosaka et al. |
| 2015/0191807 | A1 | 7/2015 | Hanlon et al. |
| 2015/0203949 | A1 | 7/2015 | Yokoi et al. |
| 2015/0218708 | A1 | 8/2015 | Maruyama et al. |
| 2016/0017465 | A1 | 1/2016 | Toda et al. |
| 2017/0349967 | A1 | 12/2017 | Yokoi et al. |
| 2018/0023162 | A1 | 1/2018 | Sugiura et al. |
| 2018/0037967 | A1 | 2/2018 | Sugiura et al. |
| 2018/0037980 | A1 | 2/2018 | Wakita et al. |
| 2018/0044749 | A1 | 2/2018 | Shuto et al. |
| 2019/0226061 | A1 | 7/2019 | Sano et al. |
| 2019/0233926 | A1 | 8/2019 | Sano et al. |
| 2019/0309398 | A1 | 10/2019 | Sano et al. |

FOREIGN PATENT DOCUMENTS

| | | | |
|---|---|---|---|
| CN | 1450191 | A | 10/2003 |
| CN | 101443467 | A | 5/2009 |
| CN | 101646794 | A | 2/2010 |
| CN | 101724776 | A | 6/2010 |
| CN | 101999007 | A | 3/2011 |
| CN | 103459647 | A | 12/2013 |
| CN | 103459648 | A | 12/2013 |
| CN | 104011234 | A | 8/2014 |
| CN | 107250411 | A | 10/2017 |
| EP | 1149925 | A1 | 10/2001 |
| EP | 1350859 | A1 | 10/2003 |
| EP | 1559797 | A1 | 8/2005 |
| EP | 2088218 | A1 | 8/2009 |
| EP | 2 182 080 | A1 | 5/2010 |
| EP | 2 453 032 | A1 | 5/2012 |
| EP | 2530180 | A1 | 12/2012 |
| EP | 2599887 | A1 | 6/2013 |
| EP | 2631314 | A1 | 8/2013 |
| EP | 2865778 | A1 | 4/2015 |
| JP | 57-70257 | A | 4/1982 |
| JP | 58-42726 | A | 3/1983 |
| JP | 61-217529 | A | 9/1986 |
| JP | 2-139646 | A | 6/1990 |
| JP | 3-180445 | A | 8/1991 |
| JP | 4-337026 | A | 11/1992 |
| JP | 5-59429 | A | 3/1993 |
| JP | 5-163590 | A | 6/1993 |
| JP | 7-90478 | A | 4/1995 |
| JP | 9-49026 | A | 2/1997 |
| JP | 10-195591 | A | 7/1998 |
| JP | 2001-200331 | A | 7/2001 |
| JP | 2001-220648 | A | 8/2001 |
| JP | 2001-303186 | A | 10/2001 |
| JP | 2002-105595 | A | 4/2002 |
| JP | 2002-161340 | A | 6/2002 |
| JP | 2002-226943 | A | 8/2002 |
| JP | 2002-317246 | A | 10/2002 |
| JP | 2002-534601 | A | 10/2002 |
| JP | 2002-322540 | A | 11/2002 |
| JP | 2002-322541 | A | 11/2002 |
| JP | 2003-342684 | A | 12/2003 |
| JP | 2004-218077 | A | 8/2004 |
| JP | 2004-250749 | A | 9/2004 |
| JP | 2004-315857 | A | 11/2004 |
| JP | 2005-82841 | A | 3/2005 |
| JP | 2005-213566 | A | 8/2005 |
| JP | 2005-220440 | A | 8/2005 |
| JP | 2005-256115 | A | 9/2005 |
| JP | 2005-298924 | A | 10/2005 |
| JP | 2005-320619 | A | 11/2005 |
| JP | 2006-274318 | A | 10/2006 |
| JP | 2007-9322 | A | 1/2007 |
| JP | 2007-138238 | A | 6/2007 |
| JP | 2007-231399 | A | 9/2007 |
| JP | 2007-247046 | A | 9/2007 |
| JP | 2007-247049 | A | 9/2007 |
| JP | 2007-314828 | A | 12/2007 |
| JP | 2008-266726 | A | 11/2008 |
| JP | 2008-285748 | A | 11/2008 |
| JP | 2009-19265 | A | 1/2009 |
| JP | 2009-24227 | A | 2/2009 |
| JP | 2009-191360 | A | 8/2009 |
| JP | 2009-270171 | A | 11/2009 |
| JP | 2009-275238 | A | 11/2009 |
| JP | 2010-168651 | A | 8/2010 |
| JP | 2010-202976 | A | 9/2010 |
| JP | 2010-248601 | A | 11/2010 |
| JP | 2010-255090 | A | 11/2010 |
| JP | 2011-140671 | A | 7/2011 |
| JP | 2011-225941 | A | 11/2011 |

(56) References Cited

FOREIGN PATENT DOCUMENTS

| | | | | |
|---|---|---|---|---|
| JP | 2012-26032 | A | 2/2012 | |
| JP | 2012-41573 | A | 3/2012 | |
| JP | 2012-62561 | A | 3/2012 | |
| JP | 2012-180569 | A | 9/2012 | |
| JP | 2012-251201 | A | 12/2012 | |
| JP | 2013-19048 | A | 1/2013 | |
| JP | 5240037 | B2 | 7/2013 | |
| JP | 2014-37595 | A | 2/2014 | |
| JP | 5445720 | B1 | 3/2014 | |
| JP | 2014-141703 | A | 8/2014 | |
| JP | 5574070 | B1 | 8/2014 | |
| JP | 5610103 | B2 | 10/2014 | |
| JP | 2015-124411 | A | 7/2015 | |
| JP | 2015-218352 | A | 12/2015 | |
| JP | 2016-50334 | A | 4/2016 | |
| KR | 10-2003-0076430 | A | 9/2003 | |
| KR | 10-0778264 | B1 | 11/2007 | |
| KR | 10-2009-0086401 | A | 8/2009 | |
| TW | 201245465 | A1 | 11/2012 | |
| TW | 201332673 | A1 | 8/2013 | |
| TW | 201413009 | A | 4/2014 | |
| TW | I467027 | B | 1/2015 | |
| TW | I470091 | B | 1/2015 | |
| WO | WO 2007/132548 | A1 | 11/2007 | |
| WO | WO 2008/056812 | A1 | 5/2008 | |
| WO | WO 2008/123366 | A1 | 10/2008 | |
| WO | WO 2010/131303 | A1 | 11/2010 | |
| WO | WO 2013/121963 | A1 | 8/2013 | |
| WO | WO 2013/150687 | A1 | 10/2013 | |
| WO | WO 2013/161090 | A1 | 10/2013 | |
| WO | WO-2013150687 | A1 * | 10/2013 | ..... C22C 38/002 |
| WO | WO 2014/014120 | A1 | 1/2014 | |
| WO | WO 2014/019844 | A1 | 2/2014 | |
| WO | WO 2014/051005 | A1 | 4/2014 | |
| WO | WO 2014/171427 | A1 | 10/2014 | |

OTHER PUBLICATIONS

Korean Office Action, dated Oct. 12, 2018, for corresponding Korean Application No. 10-2017-7024039, with an English translation.
International Search Report for PCT/JP2015/055464 (PCT/ISA/210) dated May 19, 2015.
International Search Report for PCT/JP2016/055074 (PCT/ISA/210) dated May 17, 2016.
Taiwanese Office Action issued in TW Patent Application No. 105105213 dated Mar. 23, 2017.
Written Opinion of the International Searching Authority for PCT/JP2016/055074 (PCT/ISA/237) dated May 17, 2016.
Extended European Search Report, dated Dec. 19, 2018, for counterpart European Application No. 16755418.7.
Extended European Search Report dated Dec. 11, 2018, in European Patent Application No. 16752608.6.
International Search Report for PCT/JP2015/054876 (PCT/ISA/210) dated May 19, 2015.
International Search Report for PCT/JP2016/055071 (PCT/ISA/210) dated May 17, 2016.
Korean Office Action dated Nov. 7, 2018 for Korean Application No. 10-2017-7023367, with an English translation.
Notice of Allowance dated Feb. 26, 2019, in Korean Patent Application No. 10-2017-7023367, with English translation.
Office Action dated May 30, 2018, in Chinese Patent Application No. 201680010703.X, with English translation.
Taiwanese Office Action issued in TW Patent Application No. 105105214 dated Mar. 23, 2017.
Written Opinion of the International Searching Authority for PCT/JP2016/055071 (PCT/ISA/237) dated May 17, 2016.
Final Office Action dated Aug. 20, 2019, issued in U.S. Appl. No. 15/551,171.
Non-Final Office Action dated Apr. 29, 2019, issued in U.S. Appl. No. 15/551,171.
U.S. Appl. No. 15/538,404, filed Jun. 21, 2017.
U.S. Appl. No. 15/549,093, filed Aug. 4, 2017.
U.S. Appl. No. 16/315,120, filed Jan. 3, 2019.
U.S. Appl. No. 16/312,222, filed Dec. 20, 2018.
U.S. Appl. No. 15/549,837, filed Aug. 9, 2017.
U.S. Appl. No. 15/551,171, filed Aug. 15, 2017.
"Development of Production Technology for Ultra Fine Grained Steels", Nakayama Steel Works, Ltd., NFG Product Introduction, 2000, total 11 pages, http://www.nakayama-steel.co.jp/menu/product/nfg.html.
Chinese Office Action and Search Report for Application No. 201580076254.4, dated May 30, 2018, with an English translation.
Chinese Office Action and Search Report, dated Jun. 1, 2018, for Chinese Patent Application No. 201580075484.9, w/translation.
Chinese Office Action and Search Report, dated Jun. 25, 2018, for Chinese Application No. 201580076157.5, with an English translation of the Office Action.
English translation of the International Preliminary Report on Patentability and Written Opinion dated Aug. 31, 2017, in PCT International Application No. PCT/JP2015/054846.
English translation of the International Preliminary Report on Patentability and Written Opinion of the International Searching Authority (Forms PCT/IB/338, PCT/IB/373 and PCT/ISA/237), dated Feb. 14, 2019, for International Application No. PCT/JP2017/028478.
Extended European Search Report for European Application No. 17837115.9, dated Nov. 28, 2019.
Extended European Search Report dated Aug. 13, 2018, in European Patent Application No. 15882644.6.
Extended European Search Report, dated Aug. 13, 2018, for European Application No. 15882647.9.
Extended European Search Report, dated Nov. 29, 2019, for European Application No. 17837116.7.
Extended European Search Report, dated Sep. 12, 2018, for European Application No. 15883192.5.
International Preliminary Report on Patentability and English translation of the Written Opinion of the International Searching Authority (forms PCT/IB/373, PCT/ISA/237 and PCT/IB/338), dated Sep. 8, 2017, for International Application No. PCT/JP2015/055455.
International Preliminary Report on Patentability and English translation of the Written Opinion of the International Searching Authority for International Application No. PCT/JP2017/028477, dated Feb. 14, 2019.
International Search Report (form PCT/ISA/210), dated May 19, 2015, for International Application No. PCT/JP2015/055455, with an English translation.
International Search Report for PCT/JP2015/054846 dated May 19, 2015.
International Search Report for PCT/JP2015/054860 dated May 19, 2015.
International Search Report for PCT/JP2017/028477 (PCT/ISA/210) dated Oct. 31, 2017.
International Search Report for PCT/JP2017/028478 (PCT/ISA/210) dated Oct. 31, 2017.
Katoh et al., Seitetsu Kenkyu, 1984, No. 312, pp. 41-50.
Kimura et al., "Misorientation Analysis of Plastic Deformation of Austenitic Stainless Steel by EBSD and X-Ray Diffraction Methods", Transactions of the Japan Society of Mechanical Engineers. A, vol. 71, No. 712, 2005, pp. 1722-1728.
Korean Notice of Allowance, dated Feb. 26, 2019, for Korean Application No. 10-2017-7023370, with an English translation.
Korean Office Action for Korean Application No. 10-2017-7023370, dated Nov. 7, 2018, with an English translation.
Office Action for TW 105105137 dated Mar. 23, 2017.
Office Action dated Sep. 3, 2018, in Korean Patent Application No. 10-2017-7018427, with English translation.
Sugimoto et al., "Stretch-flangeability of a High-strength TRIP Type Bainitic Sheet Steel", ISIJ International, 2000, vol. 40, No. 9, pp. 920-926.
Takahashi, "Development of High Strength Steels for Automobiles", Nippon Steel Technical Report, Jul. 2003, No. 378, pp. 2-7.
U.S. Final Office Action, dated Dec. 10, 2019, for U.S. Appl. No. 15,549,837.

(56) References Cited

OTHER PUBLICATIONS

U.S. Final Office Action, dated Sep. 18, 2019, for U.S. Appl. No. 15,549,093.
U.S. Notice of Allowance, dated Feb. 12, 2020, for U.S. Appl. No. 15,549,093.
U.S. Notice of Allowance, dated Jan. 10, 2020, for U.S. Appl. No. 15,549,093.
U.S. Office Action, dated Apr. 29, 2019, for U.S. Appl. No. 15/549,093.
U.S. Office Action, dated Mar. 17, 2020, for U.S. Appl. No. 15/551,171.
U.S. Office Action, dated Mar. 2, 2020, for U.S. Appl. No. 16/312,222.
U.S. Office Action, dated Mar. 22, 2019, for U.S. Appl. No. 15/538,404.
U.S. Office Action, dated May 31, 2019, for U.S. Appl. No. 15/549,837.
U.S. Office Action, dated Nov. 18, 2019, for U.S. Appl. No. 15/538,404.
Written Opinion of the International Searching Authority for PCT/JP2015/054846 (PCT/ISA/237) dated May 19, 2015.
Written Opinion of the International Searching Authority for PCT/JP2015/0548460 (PCT/ISA/237) dated May 19, 2015.
Written Opinion of the International Searching Authority for PCT/JP2015/055455 (PCT/ISA/237) dated May 19, 2015.
Written Opinion of the International Searching Authority for PCT/JP2017/028477 (PCT/ISA/237) dated Oct. 31, 2017.
Written Opinion of the International Searching Authority for PCT/JP2017/028478 (PCT/ISA/237) dated Oct. 31, 2017.

* cited by examiner

HOT-ROLLED STEEL SHEET

TECHNICAL FIELD OF THE INVENTION

The present invention relates to a hot-rolled steel sheet excellent in workability and particularly relates to a hot-rolled steel sheet excellent in stretch flangeability.

RELATED ART

In recent years, in response to the demand for reduction in weight of various members for the purpose of improving fuel economy of vehicles, reduction in thickness by increasing strength of a steel sheet such as an iron alloy used for the members, and application of light metals such as an Al alloy to the various members have been proceeded. However, as compared with heavy metals such as steel, the light metals such as an Al alloy have an advantage of high specific strength, but are extremely expensive. For this reason, the application of the light metal such as an Al alloy is limited to special applications. Accordingly, in order to apply the reduction in the weight of the various members to a cheaper and wider range, it is required to reduce the thickness by increasing the strength of the steel sheet.

When the steel sheet is strengthened, the material properties such as formability (workability) are generally deteriorated. Thus, in the developing of the high-strength steel sheet, it is an important problem to achieve the high strength of the steel sheet without deteriorating the material properties. Particularly, stretch-flange formability, burring workability, ductility, fatigue durability, impact resistance, corrosion resistance, and the like, are required depending on the application for the steel sheet used as vehicle members such as an inner plate member, a structural member, and a suspension member. Therefore, it is important to realize both of the material properties and the strength.

For example, among the vehicle members, the steel sheets used for the structural member, the suspension member, and the like, which account for about 20% of the vehicle body weight are press-formed mainly based on stretch flange processing and burring processing after performing blanking and drilling by shearing or punching. For this reason, excellent stretch flangeability is required for such steel sheets.

With respect to the above-described problem, for example, Patent Document 1 discloses it is possible to provide a hot-rolled steel sheet which is excellent in ductility, stretch flangeability, and material uniformity by limiting the size of TiC.

In addition, Patent Document 2 discloses an invention of a hot-rolled steel sheet which is obtained by controlling types, a size, and a number density of oxides, and is excellent in the stretch flangeability and fatigue properties.

Further, Patent Document 3 discloses an invention of a hot-rolled steel sheet which has small unevenness in the strength and is excellent in the ductility and hole expansibility by controlling an area ratio of ferrite and a hardness difference of the ferrite and a second phase.

However, in the technique disclosed in Patent Document 1, it is necessary to secure the ferrite to be equal to or greater than 95% in the structure of the steel sheet. For this reason, in order to secure sufficient strength, it is necessary to contain Ti of equal to or greater than 0.08% even in a case of 590 MPa class (TS is equal to or greater than 590 MPa). However, in the steel having the soft ferrite of equal to or greater than 95%, in the case of securing the strength of the steel of equal to or greater than 590 MPa by precipitation strengthening of TiC, there is a problem in that the ductility is deteriorated.

Moreover, in the technique disclosed in Patent Document 2, it is essential to add rare metals such as La and Ce. In the technique disclosed in Patent Document 3, it is necessary to set Si which is an inexpensive strengthening element to be equal to or less than 0.1%. Accordingly, the techniques disclosed in Patent Documents 2 and 3 commonly have a problem of constraints of alloying elements.

In addition, as described above, in recent years, the demand for the application of the high-strength steel sheet to the vehicle members have been increased. In a case where the high-strength steel sheet is press-formed by cold working, cracks likely to occur at an edge of a portion which is subjected to the stretch flange forming during the forming process. The reason for this is that work hardening is performed only on an edge portion due to the strain which is introduced to a punched end surface at the time of blanking. In the related art, as a method of evaluating a test of the stretch flangeability, a hole expansion test has been used. However, in the hole expansion test, breaking occurs without the strains in the circumferential direction are hardly distributed; however, in the actual process of components, strain distribution is present, and thus a gradient of the strain and the stress in the vicinity of the broken portion affects a breaking limit. Accordingly, regarding the high-strength steel sheet, even if the sufficient stretch flangeability is exhibited in the hole expansion test, in a case of performing cold pressing, the breaking may occur due to the strain distribution.

The techniques disclosed in Patent Documents 1 to 3 disclose that in all of the inventions, the hole expansibility is improved by specifying only the structures observed by using an optical microscope. However, it is not clear whether or not sufficient stretch flangeability can be secured even in consideration of the strain distribution.

PRIOR ART DOCUMENT

Patent Document

[Patent Document 1] PCT International Publication No. WO2013/161090

[Patent Document 2] Japanese Unexamined Patent Application, First Publication No. 2005-256115

[Patent Document 3] Japanese Unexamined Patent Application, First Publication No. 2011-140671

DISCLOSURE OF THE INVENTION

Problems to be Solved by the Invention

The present invention has been made in consideration of the above described circumstance.

An object of the present invention is to provide an inexpensive high-strength hot-rolled steel sheet which is excellent in the stretch flangeability and can be applied to a member which requires high strength and the strict stretch flangeability. In the present invention, the stretch flangeability means a value evaluated by a product of limit forming height H (mm) and tensile strength (MPa) of the flange obtained as a result of the test by the saddle type stretch flange test method, which is an index of the stretch flangeability in consideration of the strain distribution. In addition, the excellent stretch flangeability means that the product of the limit forming height H (mm) and the tensile strength (MPa) of the flange is equal to or greater than 19500 mm·MPa.

In addition, the high strength means that the tensile strength is equal to or greater than 590 MPa.

Means for Solving the Problem

According to the related art, the improvement of the stretch flangeability (hole expansibility) has been performed by inclusion control, homogenization of structure, unification of structure, and/or reduction in hardness difference between structures, as disclosed in Patent Documents 1 to 3. In other words, in the related art, the stretch flangeability, or the like has been improved by controlling the structure which can be observed by using an optical microscope.

In this regard, the present inventors made an intensive study by focusing an intragranular orientation difference in grains in consideration that the stretch flangeability under the presence of the strain distribution cannot be improved even by controlling only the structure observed by using an optical microscope. As a result, it was found that it is possible to greatly improve the stretch flangeability by controlling the ratio of the grains in which the intragranular orientation difference is in a range of 5° to 14° with respect to the entire grains to be within a certain range.

The present invention is configured on the basis of the above findings, and the gists thereof are as follows.

(1) A hot-rolled steel sheet according to one aspect of the present invention includes, as a chemical composition, by mass %, C: 0.020% to 0.070%, Si: 0.10% to 1.70%, Mn: 0.60% to 2.50%, Al: 0.01% to 1.00%, Ti: 0.015% to 0.170%, Nb: 0.005% to 0.050%, Cr: 0% to 1.0%, B: 0% to 0.10%, Mo: 0% to 1.0%, Cu: 0% to 2.0%, Ni: 0% to 2.0%, Mg: 0% to 0.05%, REM: 0% to 0.05%, Ca: 0% to 0.05%, Zr: 0% to 0.05%, P: limited to equal to or less than 0.05%, S: limited to equal to or less than 0.010%, and N: limited to equal to or less than 0.0060%, with the remainder of Fe and impurities; in which a structure includes, by area ratio, a ferrite in a range of 5% to 60% and a bainite in a range of 30% to 95%, and in which in the structure, in a case where a boundary having an orientation difference of equal to or greater than 15° is defined as a grain boundary, and an area which is surrounded by the grain boundary and has an equivalent circle diameter of equal to or greater than 0.3 μm is defined as a grain, the ratio of the grains having an intragranular orientation difference in a range of 5° to 14° is, by area ratio, in a range of 20% to 100%.

(2) In the hot-rolled steel sheet described in the above (1), a tensile strength may be equal to or greater than 590 MPa, and a product of the tensile strength and a limit forming height in a saddle type stretch flange test may be equal to or greater than 19500 mm·MPa.

(3) In the hot-rolled steel sheet described in the above (1) or (2), the chemical composition may contain, by mass %, one or more selected from Cr: 0.05% to 1.0%, and B: 0.0005% to 0.10%.

(4) In the hot-rolled steel sheet described in any one of the above (1) to (3), the chemical composition may contain, by mass %, one or more selected from Mo: 0.01% to 1.0%, Cu: 0.01% to 2.0%, and Ni: 0.01% to 2.0%.

(5) In the hot-rolled steel sheet described in any one of the above (1) to (4), the chemical composition may contain, by mass %, one or more selected from Ca: 0.0001% to 0.05%, Mg: 0.0001% to 0.05%, Zr: 0.0001% to 0.05%, and REM: 0.0001% to 0.05%.

Effects of the Invention

According to the above-described aspects of the present invention, it is possible to provide a high-strength hot-rolled steel sheet which has high strength, can be applied to a member that requires strict stretch flangeability, and is excellent in the stretch flangeability.

EMBODIMENTS OF THE INVENTION

Figure 1:
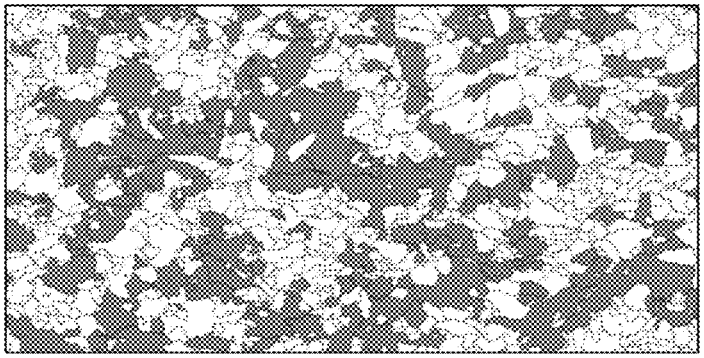
FIG. 1 is an analysis result obtained by EBSD at ¼t portion (a ¼ thickness position from the surface in the sheet thickness direction) of a hot-rolled steel sheet according to the present embodiment.

Hereinafter, a hot-rolled steel sheet (hereinafter, referred to as a hot-rolled steel sheet according to the present embodiment in some case) of the embodiment of the present invention will be described in detail.

The hot-rolled steel sheet according to the present embodiment includes, as a chemical composition, by mass %, C: 0.020% to 0.070%, Si: 0.10% to 1.70%, Mn: 0.60% to 2.50%, Al: 0.01% to 1.00%, Ti: 0.015% to 0.170%, Nb: 0.005% to 0.050%, and optionally Cr: 1.0% or less, B: 0.10% or less, Mo: 1.0% or less Cu: 2.0% or less, Ni: 2.0% or less, Mg: 0.05% or less, REM: 0.05% or less, Ca: 0.05% or less, Zr: 0.05% or less, and P: limited to equal to or less than 0.05%, S: limited to equal to or less than 0.010%, and N: limited to equal to or less than 0.006%, with the remainder of Fe and impurities.

In addition, a structure has, by area ratio, ferrite in a range of 5% to 60% and bainite in a range of 30% to 95%, and in the structure, in a case where a boundary having an orientation difference of equal to or greater than 15° is defined as a grain boundary, and an area which is surrounded by the grain boundary and has an equivalent circle diameter of equal to or greater than 0.3 μm is defined as a grain, the ratio of the grains having an intragranular orientation difference in a range of 5° to 14° is, by area ratio, in a range of 20% to 100%.

First, the reason for limiting the chemical composition of the hot-rolled steel sheet according to the present embodiment will be described. The content (%) of the respective elements is based on mass %.

C: 0.020% to 0.070%

C is an element which forms a precipitate in the steel sheet by being bonded to Nb, Ti, and the like, and contributes to improvement of the strength of steel by precipitation strengthening. In order to obtain the aforementioned effect, the lower limit of the C content is set to 0.020%. The lower limit of the C content is preferably 0.025%, and the lower limit of the C content is further preferably 0.030%. On the other hand, when the C content is greater than 0.070%, an orientation dispersion in the bainite tends to be increased, and the ratio of grains having the intragranular orientation difference in a range of 5° to 14° is decreased. In addition, the generation of the cementite harmful to the stretch flangeability is increased, and thus the stretch flangeability is deteriorated. Thus, the upper limit of the C content is set to 0.070%. The upper limit of the C content is preferably 0.065%, and the upper limit of the C content is more preferably 0.060%.

Si: 0.10% to 1.70%

Si is an element which contributes to improvement of the strength of steel. In addition, Si is an element having a role as a deoxidizing agent of molten steel. In order to obtain the aforementioned effect, the lower limit of the Si content is set to 0.10%. The lower limit of the Si content is preferably 0.30%, the lower limit of the Si content is more preferably 0.50%, and the lower limit of the Si content is further preferably 0.70%. On the other hand, when the Si content is greater than 1.70%, the stretch flangeability is deteriorated, and surface defects may occur. In addition, transformation point becomes excessively high, and thus the rolling temperature is necessary to be increased. In this case, recrystallization during the hot rolling is remarkably accelerated, and thereby the ratio of the grains having the intragranular orientation difference in a range of 5° to 14° is decreased. For this reason, the upper limit of the Si content is set to 1.70%. The upper limit of the Si content is preferably 1.50%, and the upper limit of the Si content is further preferably 1.30%.

Mn: 0.60% to 2.50%

Mn is an element which contributes to the improvement of the strength of steel by the solid solution strengthening or improving the hardenability of the steel. In order to obtain the aforementioned effect, the lower limit of the Mn content is set to 0.60%. The lower limit of the Mn content is preferably 0.70%, and the lower limit of the Mn content is further preferably 0.80%. On the other hand, when the Mn content is greater than 2.50%, as the hardenability is excessively high and the degree of the orientation dispersion in the bainite is increased, the ratio of the grains having the intragranular orientation difference in a range of 5° to 14° is decreased, and thereby the stretch flangeability is deteriorated. For this reason, the upper limit of the Mn content is set 2.50%. The upper limit of the Mn content is preferably 2.30%, and is further preferably the upper limit of the Mn content is 2.10%.

Al: 0.010% to 1.00%

Al is an effective element as a deoxidizing agent of molten steel. In order to obtain such effect, the lower limit of the Al content is set to 0.010%. The lower limit of the Al content is preferably 0.020%, and the lower limit of the Al content is further preferably 0.030%. On the other hand, the Al content is greater than 1.00%, the weldability and the toughness are deteriorated, and thus breaking may occur during the rolling. For this reason, the upper limit of the Al content is set to 1.00%. The upper limit of the Al content is preferably 0.90%, and the upper limit of the Al content is further preferably 0.80%.

Ti: 0.015% to 0.170%

Ti is an element which is finely precipitated in the steel as carbide and improves the strength of steel by precipitation strengthening. In addition, Ti is an element for forming carbide (TiC) so as to fix C, and suppress the generation of cementite which is harmful to the stretch flangeability. In order to obtain the above-described effects, the lower limit of the Ti content is set to 0.015%. The lower limit of the Ti content is preferably 0.020%, and the lower limit of the Ti content is further preferably 0.025%. On the other hand, when the Ti content is greater than 0.170%, the ductility is deteriorated. For this reason, the upper limit of the Ti content is set to 0.170%. The upper limit of the Ti content is preferably 0.150%, and the upper limit of the Ti content is further preferably 0.130%.

Nb: 0.005% to 0.050%

Nb is an element which is finely precipitated in the steel as carbide and improves the strength of steel by precipitation strengthening. In addition, Nb is an element for forming carbide (NbC) so as to fix C, and suppress the generation of cementite which is harmful to the stretch flangeability. In order to obtain the above-described effects, the lower limit of the Nb content is set to 0.005%. The lower limit of the Nb content is preferably 0.010%, and the lower limit of the Nb content is further preferably 0.015%. On the other hand, when the Nb content is greater than 0.050%, the ductility is deteriorated. In addition, the recrystallization during the hot rolling is significantly inhibited, and thus the intragranular orientation difference is excessively large, thereby decreasing the ratio of the grains having an intragranular orientation difference in a range of 5° to 14°. For this reason, the upper limit of the Nb content is set to 0.050%. The upper limit of the Nb content is preferably 0.040%, and the upper limit of the Nb content is further preferably 0.035%.

P: Equal to or Less than 0.05%

P is an impurity. P causes the toughness, the ductility, and the weldability to be deteriorated, and thus the less the content is, the more preferable. However, in a case where the P content is greater than 0.05%, the stretch flangeability is remarkably deteriorated, and thus the P content may be limited to be equal to or less than 0.05%. The P content is further preferably equal to or less than 0.03% and is still further preferably equal to or less than 0.02%. Although, there is no need to particularly specify the lower limit of the P content, excessive reduction of the P content is undesirable from the viewpoint of manufacturing cost, and thus the lower limit of the P content may be 0.005%.

S: Equal to or Less than 0.010%

S is an element for forming an A-type inclusion which not only causes cracks at the time of hot rolling, but also makes the stretch flangeability deteriorated. For this reason, the less the S content is, the more preferable. However, when the S content is greater than 0.010%, the stretch flangeability is remarkably deteriorated, and thus the upper limit of the S content may be limited to be 0.010%. The S content is preferably equal to or less than 0.005, and is further preferably equal to or less than 0.003%. Although, there is no need to particularly specify the lower limit of the S content, excessive reduction of the S content is undesirable from the viewpoint of manufacturing cost, and thus the lower limit of S content may be 0.001%.

N: Equal to or Less than 0.0060%

N is an element which forms precipitates with Ti, Nb, in preference to C, and decreases Ti and Nb effective for fixing C. For this reason, the less the N content is, more preferable. However, in a case where the N content is greater than 0.0060%, the stretch flangeability is remarkably deteriorated, and thus the N content may be limited to be equal to or less than 0.0060%. The N content is preferably equal to or less than 0.0050%. Although, there is no need to particularly specified the N content, excessive reduction of the N content is undesirable from the viewpoint of manufacturing cost, and thus the lower limit of the N content may be equal to or greater than 0.0010%.

The above-described chemical elements are base elements contained in the hot-rolled steel sheet according to the present embodiment, and a chemical composition which contains such base elements, with the remainder of Fe and impurities is a base composition of the hot-rolled steel sheet according to the present embodiment. However, in addition to the base elements (instead of a portion of Fe of the remainder), the hot-rolled steel sheet according to the present embodiment may contains, if necessary, one or more elements selected from the following chemical elements (selective elements). It is not necessary to contain the following elements, and thus the lower limit of the content is 0%. Even when such selective elements are unavoidably contaminated in the steel (for example, by the content which is less than the lower limit of the amount of each element) the effect in the present embodiment is not impaired.

Here, the impurities are elements contaminated in the steel, which are caused from raw materials such as ore and scrap at the time of industrially manufacturing the alloy, or caused by various factors in the manufacturing process, and are in an allowable range which does not adversely affect the properties of the hot-rolled steel sheet according to the present embodiment.

Cr: 0 to 1.0%

Cr is an element which contributes to improvement of the strength of steel. In a case of obtaining such an effect, the Cr content is preferably equal to or greater than 0.05%. On the other hand, when the Cr content is greater than 1.0%, the effect is saturated and the economic efficiency is deteriorated. Accordingly, even in a case of containing Cr, the upper limit of the Cr content is preferably set to be 1.0%.

B: 0% to 0.10%

B is an element which improves the hardenability and increases the structure fraction of a low temperature transformation phase which is a hard phase. In a case of obtaining such an effect, the B content is preferably equal to or greater than 0.0005%. On the other hand, when the B content is greater than 0.10%, the effect is saturated and the economic efficiency is deteriorated. Accordingly, even in the case of containing B, the upper limit of the B content is preferably set to 0.10%.

Mo: 0.01% to 1.0%

Mo is an element which improves the hardenability and has an effect of enhancing the strength by forming a carbide. In order to obtain such effects, the Mo content is preferably equal to or greater than 0.01%. On the other hand, when the Mo content is greater than 1.0%, the ductility and the weldability are deteriorated. For this reason, the upper limit of the Mo content is set to 1.0% even in a case of containing Mo.

Cu: 0.01% to 2.0%

Cu is an element which improves the strength of steel sheet and improves corrosion resistance and the exfoliation properties of the scale. In order to obtain such effects, the Cu content is preferably equal to or greater than 0.01%, and is further preferably equal to or greater than 0.04%. On the other hand, when the Cu content is greater than 2.0%, surface defects may occur. For this reason, even in the case of containing Cu, the upper limit of the Cu content is preferably set to 2.0%, and is further preferably set to 1.0%.

Ni: 0.01% to 2.0%

Ni is an element which improves the strength and the toughness of the steel sheet. In order to obtain such effects, the Ni content is preferably equal to or greater than 0.01%. On the other hand, when the Ni content is greater than 2.0%, the ductility is deteriorated. For this reason, even in the case of containing Ni, the upper limit of the Ni content is preferably set to 2.0%.

Ca: 0.0001% to 0.05%

Mg: 0.0001% to 0.05%

Zr: 0.0001% to 0.05%

REM: 0.0001% to 0.05%

All of Ca, Mg, Zr, and REM are elements which improve the toughness by controlling the shape of sulfides or oxides. Accordingly, in order to obtain such effects, each of one or more of these elements is preferably equal to or greater than 0.0001%, and is further preferably equal to or greater than 0.0005%. However, when the amount of these elements is excessively high, the stretch flangeability is deteriorated. For this reason, even in the case of containing these elements, the upper limit of each of the contents is preferably set to 0.05%.

Next, the structure (metallographic structure) of the hot-rolled steel sheet according to the present embodiment will be described.

It is necessary that the hot-rolled steel sheet according to the present embodiment contain, by area ratio, ferrite in a range of 5% to 60% and bainite in a range of 30% to 95%, in the structure observed by using an optical microscope. With such a structure, it is possible to improve the strength and the workability in well balance. When the fraction (area ratio) of the ferrite is less than 5% by area ratio, the ductility is deteriorated, and thus it is difficult to secure the properties generally required for the vehicle members. On the other hand, when the fraction of the ferrite is greater than 60%, the stretch flangeability is deteriorated, and it is difficult to obtain a desired strength of the steel sheet. For this reason, the fraction of the ferrite is set to 5% to 60%.

In addition, when the fraction of the bainite is less than 30%, the stretch flangeability is deteriorated. On the other hand, the fraction of the bainite is greater than 95%, the ductility is deteriorated. For this reason, the fraction of the bainite is set to be in a range of 30% to 95%.

The structure of the remainder other than the ferrite and bainite is not particularly limited, and for example, it may be martensite, residual austenite, pearlite, or the like. However, when the structure fraction of the remainder is excessively high, the stretch flangeability may be deteriorated, and thus the ratio of the remainder is preferably equal to or less than 10% in total. In other words, the ratio of the ferrite and the bainite is preferably equal to or more than 90% in total by area ratio. The ratio of the ferrite and the bainite is further preferably 100% in total by area ratio.

The structure fraction (the area ratio) can be obtained using the following method. First, a sample collected from the hot-rolled steel sheet is etched by using nital. After etching, a structure photograph obtained at a ¼ thickness position in a visual field of 300 μm×300 μm by using an optical microscope is subjected to image analysis, and thereby the area ratio of ferrite and pearlite, and the total area ratio bainite and martensite are obtained. Then, With a sample etched by Lepera solution, the structure photograph obtained at a ¼ thickness position in the visual field of 300 μm×300 μm by using the optical microscope is subjected to the image analysis, and thereby the total area ratio of residual austenite and martensite is calculated.

Further, with a sample obtained by grinding the surface to a depth of ¼ thickness from the rolled surface in the normal direction, the volume fraction of the residual austenite is obtained through X-ray diffraction measurement. The volume fraction of the residual austenite is equivalent to the area ratio, and thus is set as the area ratio of the residual austenite.

With such a method, it is possible to obtain the area ratio of each of ferrite, bainite, martensite, residual austenite, and pearlite.

In the hot-rolled steel sheet according to the present embodiment, it is necessary to control the structure observed by using the optical microscope to be within the above-described range, and further to control the ratio of the grains having the intragranular orientation difference in a range of 5° to 14°, obtained using an EBSD method (electron beam back scattering diffraction pattern analysis method) frequently used for the crystal orientation analysis. Specifically, in a case where the grain boundary is defined as a boundary having the orientation difference of equal to or higher than 15°, and an area which is surrounded by the grain boundary, is defined as the grain, the ratio of the grains having the intragranular orientation difference in a range of 5° to 14° is set to equal to or greater than 20% by area ratio, with respect to the entire grains.

The reason why the ratio of the grains having the intragranular orientation difference in a range of 5° to 14° is set to equal to or greater than 20% by area ratio is that when it is less than 20%, it is not possible to obtain a desired strength of the steel sheet and the stretch flangeability. The ratio of the grains having the intragranular orientation difference in a range of 5° to 14° may become higher, and thus the upper limit is set to 100%.

The grains having the intragranular orientation difference are effective to obtain a steel sheet which has the strength and the workability in the excellent balance, and thus by controlling the ratio, it is possible to greatly improve the stretch flangeability while maintaining a desired steel sheet strength.

In this regard, it is considered that the intragranular orientation difference is related to a dislocation density contained in the grains. Typically, the increase in the intragranular dislocation density causes the workability to be deteriorated while bringing about the improvement of the strength. However, the grain in which the intragranular orientation difference is controlled to be in a range of 5° to 14°, can improve the strength without deteriorating the workability. For this reason, in the hot-rolled steel sheet according to the present embodiment, the ratio of the grains having the intragranular orientation difference in a range of 5° to 14° is controlled to be equal to or greater than 20%. The grains having an intragranular orientation difference of less lower 5° are excellent in the workability, but are hard to be highly strengthened, and the grains having the intragranular orientation difference of greater than 14° have different deformations therein, and thus do not contribute to the improvement of stretch flangeability.

The ratio of the grains having an intragranular orientation difference in a range of 5° to 14° can be measured by the following method.

First, at a position of depth of ¼ (¼t portion) thickness t from surface of the steel sheet in a cross section vertical to a rolling direction, an area of 200 μm in the rolling direction, and 100 μm in the normal direction of the rolled surface is subjected to EBSD analysis at a measurement gap of 0.2 μm so as to obtain crystal orientation information. Here, the EBSD analysis is performed using an apparatus which is configured to include a thermal field emission scanning electron microscope (JSM-7001F, manufactured by JEOL) and an EBSD detector (HIKARI detector manufactured by TSL), at an analysis speed in a range of 200 to 300 points per second. Then, with respect to the obtained crystal orientation information, an area having the orientation difference of equal to or greater than 15° and an equivalent circle diameter of equal to or greater than 0.3 μm is defined as grain, an average intragranular orientation difference of the grains is calculated, and the ratio of the grains having the intragranular orientation difference in a range of 5° to 14° is obtained. The grain defined as described above and the average intragranular orientation difference can be calculated by using software "OIM Analysis (trademark)" attached to an EBSD analyzer.

The "intragranular orientation difference" of the present invention means "Grain Orientation Spread (GOS)" which is an orientation dispersion in the grains, and the value thereof is obtained as an average value of reference crystal orientations and misorientations of all of the measurement points within the same grain as disclosed in "Misorientation Analysis of Plastic Deformation of Stainless Steel by EBSD and X-Ray Diffraction Methods", KIMURA Hidehiko, journal of the Japan Society of Mechanical Engineers (Series A) Vol. 71, No. 712, 2005, p. 1722 to 1728. In the present embodiment, the reference crystal orientation is an orientation obtained by averaging all of the measurement points in the same grain, a value of GOS can be calculated by using "OIM Analysis (trademark) Version 7.0.1" which is software attached to the EBSD analyzer.

FIG. 1 is an EBSD analysis result of an area of 100 μm×100 μm on the vertical section in the rolling direction, which is ¼t portion of the hot-rolled steel sheet according to the present embodiment. In FIG. 1, an area which is surrounded by the grain boundary having the orientation difference of equal to or greater than 15°, and has the intragranular orientation difference in a range of 5° to 14° is shown in gray.

Figure 2:
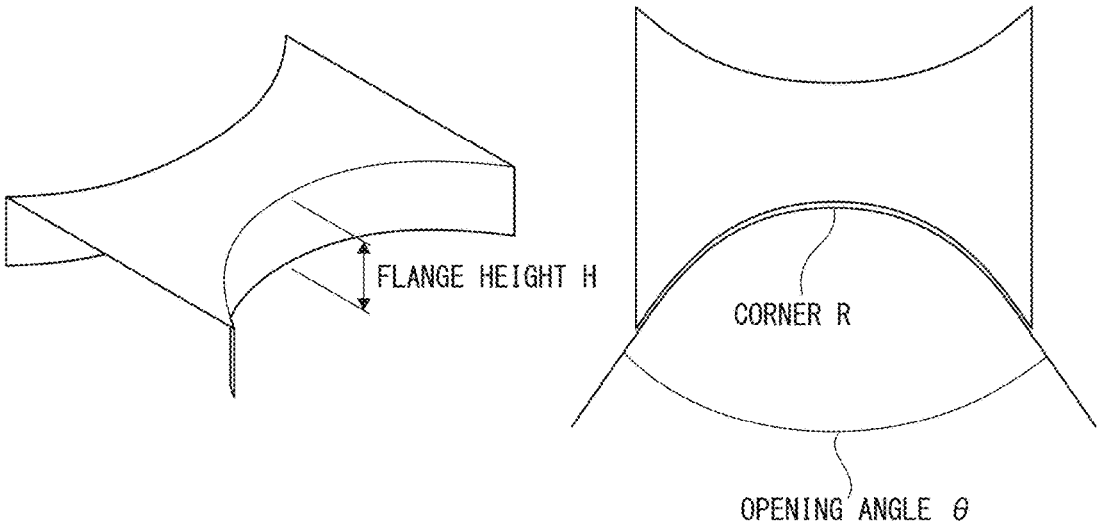
FIG. 2 is a diagram showing a shape of a saddle-shaped formed product which is used in a saddle type stretch flange test method.

In the present embodiment, the stretch flangeability is evaluated by using the saddle type stretch flange test method in which the saddle-shaped formed product is used. Specifically, the saddle-shaped formed product simulating the stretch flange shape including a linear portion and an arc portion as shown in FIG. 2 is pressed, and the stretch flangeability is evaluated by using a limit forming height at this time. In the saddle type stretch flange test of the present embodiment, the limit forming height H (mm) when a clearance at the time of punching a corner portion is set to 11%, is measured by using the saddle-type formed product in which a radius of curvature R of a corner is set to in a range of 50 to 60 mm, and an opening angle θ is set to 120°. Here, the clearance indicates the ratio of a gap between a punching die and a punch, and the thickness of the test piece. Actually, the clearance is determined by combination of a punching tool and the sheet thickness, and thus the value of 11% means a range of 10.5% to 11.5% is satisfied. The existence of the cracks having a length of ⅓ of the sheet thickness are visually observed after forming, and then a forming height of the limit in which the cracks are not present is determined as the limit forming height.

In a hole expansion test which is used as a test method evaluating the stretch flange formability in the related art, breaking occurs without the strains in the circumferential direction are hardly distributed, and thus have a different gradient of the strain and the stress in the vicinity of the broken portion from that in the case of actually forming the stretch flange. In addition, in the hole expansion test, the evaluation reflecting the original stretch flange forming is not performed, since the evaluation when the rupture of the thickness penetration occurred. On the other hand, in the saddle type stretch flange test used in the present embodiment, it is possible to evaluate the stretch flangeability in consideration of the strain distribution, and thus the evaluation reflecting the original stretch flange forming can be performed.

In the hot-rolled steel sheet according to the present embodiment, the area ratio of each of the structures of the ferrite and bainite which are observed by using the optical microscope is not directly related to the ratio of the grains having the intragranular orientation difference in a range of 5° to 14°. In other words, for example, even if there are a hot-rolled steel sheets in which ferrite and bainite have the area ratio as each other, the ratio of the grains having the intragranular orientation difference in a range of 5° to 14° of the steel sheets are not necessarily the same. Accordingly, it is not possible to obtain the properties corresponding to the hot-rolled steel sheet according to the present embodiment only by controlling the ferrite area ratio and the bainite area ratio.

The hot-rolled steel sheet according to the present embodiment can be obtained using a manufacturing method including a hot rolling process and a cooling process as follows.

<Regarding Hot Rolling Process>

In the hot rolling process, the hot-rolled steel sheet is obtained through the hot rolling by heating a slab having the above-described chemical composition. The slab heating temperature is preferably in a range of SRTmin° C., expressed by the following Expression (a), to 1260° C.

$$SRT\text{min}=7000/\{2.75-\log([\text{Ti}]\times[\text{C}])\}-273 \quad \text{(a)}$$

Here, [Ti] and [C] in Expression (a) indicate the amounts of Ti and C, by mass %.

Since the hot-rolled steel sheet according to the present embodiment contains Ti, when the slab heating temperature is lower than SRTmin° C., Ti is not sufficiently solutionized. When Ti is not solutionized at the time of heating the slab, it is difficult that the Ti is finely precipitated as carbide (TiC) so as to improve the strength of steel by the precipitation strengthening. In addition, it is difficult that the carbide (TiC) is formed so as to fix C, and the generation of the cementite harmful to the burring properties is suppressed. In this case, the ratio of the grains having the intragranular orientation difference in a range of 5° to 14° is also decreased, which is not preferable.

On the other hand, when the heating temperature is higher than 1260° C. in the slab heating process, the yield is decreased due to the scale off, and thus the heating temperature is preferably in a range of SRTmin° C. to 1260° C.

In a case where the ratio of the grains having the intragranular orientation difference in a range of 5° to 14° is set to be equal to or greater than 20%, in the hot rolling performed on the heated slab, it is effective to set cumulative strains in a latter three stages (last three passes) of finish rolling to be in a range of 0.5 to 0.6, and then perform cooling described below. The reason for this is that the grain having the intragranular orientation difference in a range of 5° to 14° is generated by being transformed at a relatively low temperature in a para-equilibrium state, and thus it is possible to control the generation of grain having the intragranular orientation difference in a range of 5° to 14° by limiting the dislocation density of austenite before the transformation to be in a certain range and limiting the cooling rate after transformation to be in a certain range.

In other words, when the cumulative strain at the latter three stages in the finish rolling, and the subsequent cooling are controlled, the grain nucleation frequency of the grain having the intragranular orientation difference in a range of 5° to 14°, and the subsequent growth rate can be controlled, and thus it is possible to control the volume fraction of the grain having the intragranular orientation difference in a range of 5° to 14° which is obtained as a result. More specifically, the dislocation density of the austenite introduced through the finish rolling is mainly related to the grain nucleation frequency, and the cooling rate after rolling is mainly related to the growth rate.

When the cumulative strain at the latter three stages in the finish rolling is less than 0.5, the dislocation density of the austenite to be introduced is not sufficient, and the ratio of the grains having the intragranular orientation difference in a range of 5° to 14° is less than 20%, which is not preferable. Further, the cumulative strain at the latter three stages in the finish rolling is greater than 0.6, the recrystallization of the austenite occurs during the hot rolling, and thus the accumulated dislocation density at the time of the transformation is decreased. In this case, the ratio of the grains having the intragranular orientation difference in a range of 5° to 14° is less than 20%, and thus the aforementioned range is not preferable.

The cumulative strain (εeff.) at the latter three stages in the finish rolling in the present embodiment can be obtained from the following Equation (1).

$$\varepsilon\text{eff.}=\Sigma\varepsilon i(t,T) \quad (1)$$

Here, $\varepsilon i(t,T)=\varepsilon i0/\exp\{(t/\iota R)^{2/3}\}$, $\iota R=\iota 0\cdot\exp(Q/RT)$, $\iota 0=8.46\times10^{-6}$, Q=183200 J, and R=8.314 J/K·mol, εi0 represents a logarithmic strain at the time of rolling reduction, t represents a cumulative time immediately before the cooling in the pass, and T represents a rolling temperature in the pass.

The rolling finishing temperature is preferably equal to or higher than Ar3° C. When the rolling finishing temperature is lower than Ar3° C., the dislocation density of austenite before the transformation is excessively high, and there by it is difficult to set the ratio of the grains having the intragranular orientation difference in a range of 5° to 14° to be equal to or greater than 20%.

Further, the hot rolling includes rough rolling and finish rolling. The finish rolling is preferably performed by using a tandem mill with which a plurality of mills is linearly arranged and continuously rolling in one direction so as to obtain a desired thickness. In addition, in a case where the finish rolling is performed using a tandem mill, it is preferable that cooling is performed between the mills (cooling between stands) such that the temperature of the steel sheet during the finish rolling is controlled to be in a range of Ar3° C. to Ar3+150° C. When the temperature of the steel sheet during the finish rolling is higher than Ar3+150° C., the grain size becomes excessively large, and thus the toughness may be deteriorated.

When the hot rolling is performed under the above-described conditions, the range of the dislocation density of austenite before the transformation is limited, it is easily obtain a desired ratio of the grains having the intragranular orientation difference in a range of 5° to 14°.

Ar3 can be calculated by the following Expression (2) based on the chemical composition of the steel sheet in consideration of the influence on the transformation point by rolling reduction.

$$\text{Ar3}=970-325\times[\text{C}]+33\times[\text{Si}]+287\times[\text{P}]+40\times[\text{Al}]-92\times([\text{Mn}]+[\text{Mo}]+[\text{Cu}])-46\times([\text{Cr}]+[\text{Ni}]) \quad (2)$$

Here, [C], [Si], [P], [Al], [Mn], [Mo], [Cu], [Cr], and [Ni] each represent, by mass %, the amounts of each of C, Si, P, Al, Mn, Mo, Cu, Cr, and Ni. The elements which are not contained are calculated as 0%.

<Regarding Cooling Process>

After hot rolling, the hot-rolled steel sheet is cooled. In the cooling process, the hot-rolled steel sheet after completing the hot rolling is cooled (first cooling) down to a temperature range in a range of 650° C. to 750° C. at a cooling rate of equal to or greater than 10° C./s, and the temperature of the steel sheet is kept for 1 to 10 seconds in the temperature range, and thereafter, the hot-rolled steel sheet is cooled (second cooling) down to the temperature range of 450° C. to 650° C. at a cooling rate of equal to or greater than 30° C./s.

When the cooling rate in the first cooling is lower than 10° C./s, the ratio of the grains having the intragranular orientation difference in a range of 5° to 14° is decreased which is not preferable. In addition, when the cooling stopping temperature in the first cooling is lower than 650° C., it is difficult to obtain an amount of ferrite equal to or greater than 5% by area ratio, and the ratio of grains having the an intragranular orientation difference in a range of 5° to 14° is decreased, which is not preferable.

In addition, when the cooling stopping temperature in the first cooling is higher than 750° C., it is difficult to obtain an amount of bainite equal to or greater than 30% by area ratio, and the ratio of grains having an intragranular orientation difference in a range of 5° to 14° is decreased, which is not preferable. In addition, even when a retention time is longer than 10 seconds at a temperature range of 650° C. to 750° C., the cementite harmful to the burring properties is likely to generate, it is difficult to obtain an amount of bainite equal to or greater than 30% by area ratio, and thereby the ratio of grains having an intragranular orientation difference in a range of 5° to 14° is decreased, which is not preferable. When the retention time at a temperature range of 650° C. to 750° C. is shorter than one second, it is difficult to obtain an amount of ferrite of equal to or greater than 5% by area ratio, and the ratio of the grains having an intragranular orientation difference in a range of 5° to 14° is decreased, which is not preferable.

In addition, when the cooling rate of the second cooling is lower than 30° C./s, the cementite harmful to the burring properties is likely to generate, and the ratio of grains having an intragranular orientation difference in a range of 5° to 14° is decreased, which is not preferable. When the cooling stopping temperature of the second cooling is lower than 450° C. or higher than 650° C., it is difficult to obtain a desire ratio of the grains having an intragranular orientation difference in a range of 5° to 14°.

Although the upper limit of the cooling rate in the first cooling and the second cooling is not necessarily limited, the cooling rate may be set to be equal to or lower than 200° C./s in consideration of the equipment capacity of the cooling facility.

According to the above-described manufacturing method, it is possible to obtain a structure which includes, by area ratio, ferrite in a range of 5% to 60% and bainite in a range of 30% to 95%, and in a case where an area which is surrounded by a grain boundary having an orientation difference of equal to or greater than 15° and has an equivalent circle diameter of equal to or less than 0.3 μm is defined as a grain, the ratio of the grains having an intragranular orientation difference in a range of 5° to 14° is, by area ratio, in a range of 20% to 100%.

In the aforementioned manufacturing method, it is important that processed dislocations are introduced into the austenite by controlling the hot rolling conditions, and then the processed dislocations introduced by controlling the cooling conditions appropriately remain. That is, it is not possible to obtain the hot-rolled steel sheet of the present embodiment by controlling any one of the hot rolling condition and the cooling condition, and thus it is important to control the hot rolling condition and the cooling condition at the same time. There is no particular limitation on conditions other than the above-described ones, and a well-known method such as a method of winding the steel sheet after the second cooling may be used.

EXAMPLES

Hereinafter, the present invention will be described more specifically with reference to examples of the hot-rolled steel sheet of the present invention; however, the present invention is not limited to Example described below, and can be implemented by being properly modified the extent that it can satisfy the object before and after description, which are all included in the technical range of the present invention.

In the present examples, first, the steel having the composition indicated in the following Table 1 was melted so as to produce a slab, the slab was heated, and was subjected to hot rough rolling, and subsequently, the finish rolling was performed under the conditions indicated in the following Table 2. The sheet thickness after the finish rolling was in a range of 2.2 to 3.4 mm. Ar3 (° C.) indicated in Table 2 was obtained from the elements indicated in Table 1 by using the following Expression (2).

$$Ar3=970-325\times[C]+33\times[Si]+287\times[P]+40\times[Al]-92\times([Mn]+[Mo]+[Cu])-46\times([Cr]+[Ni]) \quad (2)$$

In addition, the cumulative strains at the last three stages were obtained by the following Expression (1).

$$\varepsilon eff.=\Sigma\varepsilon i(t,T) \quad (1)$$

Here, $\varepsilon i(t,T)=\varepsilon i0/\exp\{(t/\iota R)^{2/3}\}$, $\iota R=\iota 0\cdot\exp(Q/RT)$, $\iota 0=8.46\times10^{-6}$, $Q=183200$ J, and $R=8.314$ J/K·mol, $\varepsilon i0$ represents a logarithmic strain at the time of rolling reduction, t represents a cumulative time immediately before the cooling in the pass, and T represents a rolling temperature in the pass.

The blank column in Table 1 means that the analysis value was less than the detection limit.

TABLE 1

| Steel | Chemical compositions (mass %, remainder: Fe and impurities) | | | | | | | | |
|---|---|---|---|---|---|---|---|---|---|
| No. | C | Si | Mn | P | S | Al | Ti | Nb | N |
| A | 0.045 | 0.40 | 0.70 | 0.010 | 0.005 | 0.050 | 0.120 | 0.030 | 0.0023 |
| B | 0.035 | 0.30 | 1.00 | 0.018 | 0.003 | 0.030 | 0.080 | 0.020 | 0.0017 |
| C | 0.068 | 1.20 | 1.20 | 0.021 | 0.006 | 0.040 | 0.100 | 0.040 | 0.0031 |
| D | 0.052 | 0.80 | 1.50 | 0.015 | 0.009 | 0.030 | 0.090 | 0.030 | 0.0025 |
| E | 0.037 | 0.20 | 1.00 | 0.012 | 0.008 | 0.040 | 0.030 | 0.020 | 0.0026 |
| F | 0.040 | 0.90 | 1.20 | 0.013 | 0.010 | 0.030 | 0.130 | 0.035 | 0.0032 |

TABLE 1-continued

| | | | | | | | | | |
|---|---|---|---|---|---|---|---|---|---|
| G | 0.062 | 0.70 | 1.20 | 0.011 | 0.009 | 0.100 | 0.090 | 0.030 | 0.0041 |
| H | 0.050 | 0.50 | 1.30 | 0.015 | 0.008 | 0.030 | 0.110 | 0.040 | 0.0026 |
| I | 0.058 | 0.60 | 1.00 | 0.009 | 0.010 | 0.080 | 0.080 | 0.020 | 0.0018 |
| J | 0.030 | 0.60 | 0.70 | 0.011 | 0.006 | 0.030 | 0.100 | 0.020 | 0.0026 |
| K | 0.041 | 1.40 | 1.70 | 0.008 | 0.003 | 0.050 | 0.120 | 0.030 | 0.0032 |
| L | 0.052 | 0.40 | 1.50 | 0.013 | 0.005 | 0.040 | 0.110 | 0.040 | 0.002 |
| M | 0.055 | 0.20 | 1.20 | 0.015 | 0.008 | 0.030 | 0.130 | 0.020 | 0.001 |
| N | 0.064 | 0.80 | 1.40 | 0.014 | 0.007 | 0.050 | 0.060 | 0.015 | 0.002 |
| O | 0.060 | 0.60 | 1.60 | 0.016 | 0.009 | 0.040 | 0.090 | 0.020 | 0.002 |
| P | 0.050 | 0.80 | 1.80 | 0.013 | 0.010 | 0.030 | 0.080 | 0.030 | 0.003 |
| Q | 0.037 | 0.10 | 1.40 | 0.008 | 0.008 | 0.200 | 0.050 | 0.010 | 0.003 |
| a | 0.120 | 0.40 | 1.20 | 0.008 | 0.006 | 0.300 | 0.060 | 0.040 | 0.001 |
| b | 0.050 | 2.70 | 1.80 | 0.009 | 0.010 | 0.050 | 0.080 | 0.030 | 0.002 |
| c | 0.045 | 0.20 | 3.20 | 0.012 | 0.008 | 0.040 | 0.050 | 0.040 | 0.003 |
| d | 0.038 | 0.50 | 0.80 | 0.010 | 0.007 | 0.030 | 0.009 | 0.020 | 0.004 |
| e | 0.062 | 0.60 | 1.70 | 0.013 | 0.008 | 0.030 | 0.230 | 0.030 | 0.002 |
| f | 0.065 | 0.30 | 1.10 | 0.011 | 0.007 | 0.040 | 0.065 | 0.000 | 0.003 |
| g | 0.048 | 0.50 | 1.20 | 0.015 | 0.009 | 0.060 | 0.120 | 0.080 | 0.003 |

| Steel | Chemical compositions (mass %, remainder: Fe and impurities) | | | | | | | | | Ar3 |
|---|---|---|---|---|---|---|---|---|---|---|
| No. | Cr | B | Mo | Cu | Ni | Mg | REM | Ca | Zr | (° C.) |
| A | | | | | | | | | | 909 |
| B | | | | | | | | | | 883 |
| C | | | | | | | | 0.001 | | 885 |
| D | 0.15 | | | | | | | | | 840 |
| E | | | | | | | | | | 871 |
| F | | | | | | | | | | 881 |
| G | | 0.0010 | | | | | | | | 870 |
| H | | | | | | | | | | 856 |
| I | | | | 0.06 | 0.03 | | | | 0.001 | 878 |
| J | | | | | | | | | | 920 |
| K | | | 0.13 | | | | | | | 839 |
| L | | | | | | | 0.005 | | | 834 |
| M | | | | 0.08 | 0.04 | | | | | 845 |
| N | | | | | | | | | | 853 |
| O | | | | | | 0.0003 | | | | 829 |
| P | | | | | | | | | | 819 |
| Q | | | | | | | | | | 843 |
| a | | | | | | | | | | 848 |
| b | | | | | | | | 0.0006 | | 974 |
| c | | | | | | | | | | 673 |
| d | | 0.0030 | | | | | | | | 905 |
| e | | | | | | | | | | 818 |
| f | | | | | | | | | | 872 |
| g | | | | | | | | | | 867 |

Underlines represent being outside of the range defined in the present invention.

TABLE 2

| Test No. | Steel No. | Ar3 | SRTmin | Heating temperature (° C.) | Rolling end temperature (° C.) | Cumulative strains at last three stages after finish rolling | Maximum temperature of steel sheet during finish rolling (° C.) | Cooling rate in first cooling (° C./s) | Cooling stopping temperature in first cooling (° C.) | Retention time at a temperature range of 650° C. to 750° C. (seconds) | Cooling rate in second cooling (° C./s) | Cooling stopping temperature in second cooling (° C.) |
|---|---|---|---|---|---|---|---|---|---|---|---|---|
| 1 | A | 909 | 1122 | 1200 | 913 | 0.55 | 1030 | 15 | 740 | 3 | 35 | 550 |
| 2 | B | 883 | 1047 | 1180 | 900 | 0.58 | 1010 | 20 | 700 | 4 | 40 | 550 |
| 3 | C | 885 | 1150 | 1220 | 902 | 0.56 | 1000 | 30 | 660 | 2 | 45 | 600 |
| 4 | D | 840 | 1105 | 1200 | 880 | 0.55 | 980 | 35 | 680 | 5 | 35 | 600 |
| 5 | E | 871 | 954 | 1180 | 900 | 0.52 | 1000 | 30 | 700 | 3 | 40 | 570 |
| 6 | F | 881 | 1118 | 1200 | 920 | 0.53 | 1020 | 20 | 680 | 4 | 50 | 510 |
| 7 | G | 870 | 1126 | 1180 | 892 | 0.54 | 990 | 35 | 710 | 6 | 33 | 480 |
| 8 | H | 856 | 1124 | 1230 | 910 | 0.59 | 1000 | 20 | 720 | 3 | 40 | 550 |
| 9 | I | 878 | 1104 | 1210 | 893 | 0.56 | 1005 | 40 | 680 | 2 | 35 | 600 |
| 10 | J | 920 | 1055 | 1230 | 930 | 0.57 | 1020 | 27 | 730 | 4 | 40 | 580 |
| 11 | K | 839 | 1111 | 1200 | 889 | 0.51 | 970 | 16 | 740 | 8 | 36 | 620 |
| 12 | L | 834 | 1129 | 1200 | 920 | 0.56 | 970 | 55 | 700 | 3 | 60 | 550 |
| 13 | M | 845 | 1157 | 1230 | 902 | 0.54 | 970 | 48 | 690 | 2 | 54 | 530 |
| 14 | N | 853 | 1082 | 1180 | 880 | 0.53 | 980 | 45 | 700 | 4 | 65 | 510 |
| 15 | O | 829 | 1122 | 1200 | 889 | 0.58 | 970 | 40 | 710 | 6 | 36 | 520 |
| 16 | P | 819 | 1087 | 1180 | 870 | 0.58 | 960 | 15 | 680 | 5 | 55 | 560 |
| 17 | Q | 843 | 1004 | 1200 | 908 | 0.59 | 987 | 23 | 730 | 5 | 49 | 600 |
| 18 | a | 848 | 1158 | 1210 | 890 | 0.55 | 990 | 30 | 690 | 4 | 35 | 580 |

TABLE 2-continued

| Test No. | Steel No. | Ar3 | SRTmin | Heating temperature (° C.) | Rolling end temperature (° C.) | Cumulative strains at last three stages after finish rolling | Maximum temperature of steel sheet during finish rolling (° C.) | Cooling rate in first cooling (° C./s) | Cooling stopping temperature in first cooling (° C.) | Retention time at a temperature range of 650° C. to 750° C. (seconds) | Cooling rate in second cooling (° C./s) | Cooling stopping temperature in second cooling (° C.) |
|---|---|---|---|---|---|---|---|---|---|---|---|---|
| 19 | b | 974 | 1087 | 1180 | 982 | 0.56 | 1079 | 25 | 700 | 5 | 45 | 550 |
| 20 | c | 673 | 1024 | 1200 | 760 | 0.57 | 820 | 43 | 740 | 6 | 37 | 540 |
| 21 | d | 905 | 853 | 1200 | 908 | 0.55 | 990 | 18 | 680 | 2 | 42 | 530 |
| 22 | e | 818 | 1250 | 1270 | 870 | 0.54 | 960 | 32 | 660 | 3 | 53 | 520 |
| 23 | f | 872 | 1093 | 1200 | 890 | 0.56 | 990 | 26 | 700 | 7 | 55 | 610 |
| 24 | g | 867 | 1130 | 1210 | 900 | 0.55 | 980 | 45 | 690 | 4 | 46 | 630 |
| 25 | M | 845 | 1157 | 1130 | 900 | 0.54 | 980 | 30 | 700 | 4 | 35 | 550 |
| 26 | C | 885 | 1150 | 1180 | 850 | 0.52 | 1010 | 15 | 720 | 3 | 50 | 570 |
| 27 | C | 885 | 1150 | 1200 | 892 | 0.44 | 1010 | 24 | 710 | 6 | 43 | 580 |
| 28 | C | 885 | 1150 | 1200 | 903 | 0.69 | 1010 | 43 | 690 | 3 | 54 | 550 |
| 29 | C | 885 | 1150 | 1210 | 950 | 0.58 | 1050 | 35 | 720 | 3 | 43 | 530 |
| 30 | C | 885 | 1150 | 1200 | 902 | 0.59 | 1010 | 3 | 700 | 6 | 35 | 550 |
| 31 | C | 885 | 1150 | 1190 | 920 | 0.56 | 1010 | 23 | 540 | 4 | 36 | 500 |
| 32 | M | 845 | 1157 | 1200 | 900 | 0.53 | 990 | 45 | 790 | 5 | 35 | 640 |
| 33 | M | 845 | 1157 | 1180 | 889 | 0.54 | 980 | 20 | 700 | 0 | 48 | 540 |
| 34 | M | 845 | 1157 | 1200 | 890 | 0.55 | 990 | 16 | 670 | 15 | 45 | 530 |
| 35 | M | 845 | 1157 | 1200 | 895 | 0.56 | 985 | 45 | 680 | 4 | 15 | 550 |
| 36 | M | 845 | 1157 | 1210 | 902 | 0.57 | 990 | 32 | 700 | 5 | 43 | 350 |
| 37 | M | 845 | 1157 | 1210 | 900 | 0.52 | 980 | 29 | 690 | 3 | 35 | 690 |

With respect to the obtained hot-rolled steel sheet, each structure fraction (the area ratio), and the ratio of the grains having the intragranular orientation difference in a range of 5° to 14° were obtained. The structure fraction (the area ratio) was obtained using the following method. First, a sample collected from the hot-rolled steel sheet was etched by using nital. After etching, a structure photograph obtained at a ¼ thickness position in a visual field of 300 μm×300 μm by using an optical microscope was subjected to image analysis, and thereby area ratio of ferrite and pearlite, and the total area ratio bainite and martensite were obtained. Then, with a sample etched by Lepera solution, the structure photograph obtained at a ¼ thickness position in the visual field of 300 μm×300 μm by using the optical microscope was subjected to the image analysis, and thereby the total area ratio of residual austenite and martensite was calculated.

Further, with a sample obtained by grinding the surface to a depth of ¼ thickness from the rolled surface in the normal direction, the volume fraction of the residual austenite was obtained through X-ray diffraction measurement. The volume fraction of the residual austenite was equivalent to the area ratio, and thus was set as the area ratio of the residual austenite.

With such a method, the area ratio of each of ferrite, bainite, martensite, residual austenite, and pearlite was obtained.

Further, the ratio of the grains having the intragranular orientation difference in a range of 5° to 14° was measured by using the following method. First, at a position of depth of ¼ (¼t portion) thickness t from surface of the steel sheet in a cross section vertical to a rolling direction, an area of 200 μm in the rolling direction, and 100 μm in the normal direction of the rolled surface was subjected to EBSD analysis at a measurement gap of 0.2 μm so as to obtain crystal orientation information. Here, the EBSD analysis was performed by using an apparatus which is configured to include a thermal field emission scanning electron microscope (JSM-7001F, manufactured by JEOL) and an EBSD detector (HIKARI detector manufactured by TSL), at an analysis speed in a range of 200 to 300 points per second. Then, with respect to the obtained crystal orientation information, an area having the orientation difference of equal to or greater than 15° and an equivalent circle diameter of equal to or greater than 0.3 μm was defined as grain, an average intragranular orientation difference of the grains was calculated, and the ratio of the grains having the intragranular orientation difference in a range of 5° to 14° was obtained. The grain defined as described above and the average intragranular orientation difference can be calculated by using software "OIM Analysis (trademark)" attached to an EBSD analyzer.

Next, the yield strength and the tensile strength were obtained in the tensile test, and the limit forming height was obtained by the saddle type stretch flange test. In addition, a product of tensile strength (MPa) and limit forming height (mm) was evaluated as an index of the stretch flangeability, and in a case where the product is equal to or greater than 19500 mm·MPa, it was determined that the steel sheet was excellent in the stretch flangeability.

The tensile test was performed according to JIS Z 2241 by using tensile test pieces No. 5 of JIS which were collected in the direction which is orthogonal to the rolling direction.

Further, the saddle type stretch flange test was conducted by setting a clearance at the time of punching a corner portion to be 11% with a saddle-type formed product in which a radius of curvature R of a corner was set to 60 mm, and an opening angle θ was set to 120°. In addition, the existence of the cracks having a length of ⅓ or more of the sheet thickness were visually observed after forming, and then a forming height of the limit in which the cracks were not present was determined as the limit forming height.

The results are indicated in Table 3.

TABLE 3

| Test No. | Ferrite area ratio (%) | Bainite area ratio (%) | Ratio of the grains having intragranualr orientation difference in a range of 5° to 14° (%) | Yield strength (MPa) | Tensile strength (MPa) | Index of stretch flange height H (mm · MPa) | Remarks |
|---|---|---|---|---|---|---|---|
| 1 | 40 | 60 | 50 | 590 | 672 | 20832 | Example of Present invention |
| 2 | 51 | 49 | 70 | 574 | 625 | 22500 | Example of Present invention |
| 3 | 13 | 87 | 60 | 770 | 831 | 21606 | Example of Present invention |
| 4 | 15 | 85 | 63 | 675 | 790 | 22120 | Example of Present invention |
| 5 | 58 | 42 | 33 | 513 | 606 | 19998 | Example of Present invention |
| 6 | 15 | 85 | 42 | 722 | 814 | 20350 | Example of Present invention |
| 7 | 27 | 73 | 53 | 625 | 724 | 20996 | Example of Present invention |
| 8 | 15 | 85 | 73 | 684 | 788 | 22064 | Example of Present invention |
| 9 | 49 | 51 | 68 | 573 | 624 | 22464 | Example of Present invention |
| 10 | 40 | 60 | 71 | 561 | 645 | 21930 | Example of Present invention |
| 11 | 12 | 88 | 48 | 780 | 860 | 20640 | Example of Present invention |
| 12 | 16 | 84 | 72 | 686 | 860 | 22360 | Example of Present invention |
| 13 | 32 | 68 | 52 | 656 | 703 | 21090 | Example of Present invention |
| 14 | 34 | 66 | 56 | 588 | 683 | 21856 | Example of Present invention |
| 15 | 25 | 75 | 80 | 577 | 716 | 22912 | Example of Present invention |
| 16 | 12 | 88 | 74 | 737 | 801 | 22428 | Example of Present invention |
| 17 | 56 | 36 | 75 | 538 | 601 | 22237 | Example of Present invention |
| 18 | 0 | 65 | 11 | 678 | 873 | 17460 | Comparative Example |
| 19 | 100 | 0 | 9 | 456 | 652 | 18258 | Comparative Example |
| 20 | 2 | 45 | 15 | 899 | 1012 | 10120 | Comparative Example |
| 21 | 67 | 33 | 27 | 423 | 523 | 20920 | Comparative Example |
| 22 | | | Cracks occur during rolling | | | | Comparative Example |
| 23 | 72 | 28 | 25 | 447 | 555 | 20535 | Comparative Example |
| 24 | 89 | 11 | 7 | 900 | 999 | 7992 | Comparative Example |
| 25 | 79 | 21 | 19 | 489 | 578 | 20230 | Comparative Example |
| 26 | 67 | 33 | 3 | 673 | 723 | 17352 | Comparative Example |
| 27 | 14 | 86 | 18 | 760 | 809 | 18607 | Comparative Example |
| 28 | 11 | 89 | 13 | 772 | 832 | 18304 | Comparative Example |
| 29 | 23 | 77 | 8 | 756 | 802 | 18446 | Comparative Example |
| 30 | 45 | 55 | 18 | 759 | 789 | 18147 | Comparative Example |
| 31 | 4 | 96 | 10 | 773 | 820 | 16400 | Comparative Example |
| 32 | 78 | 22 | 17 | 559 | 653 | 17631 | Comparative Example |
| 33 | 2 | 98 | 18 | 623 | 745 | 16390 | Comparative Example |
| 34 | 82 | 18 | 13 | 555 | 649 | 16874 | Comparative Example |
| 35 | 69 | 31 | 11 | 566 | 679 | 16975 | Comparative Example |
| 36 | 43 | 49 | 12 | 598 | 763 | 19075 | Comparative Example |
| 37 | 78 | 22 | 10 | 570 | 678 | 17628 | Comparative Example |

As apparent from the results of Table 3, in a case where steel having the chemical composition specified in the present invention was hot-rolled under the preferable conditions (Test Nos. 1 to 17), it was possible to obtain the high-strength hot-rolled steel sheet in which the strength is equal to or greater than 590 MPa, and an index of the stretch flangeability is equal to or greater than 19500 mm·MPa.

On the other hand, Manufacture Nos. 18 to 24 are Comparative Examples using Steel Nos. a to g in which the chemical composition was outside the range of the present invention. In addition, Manufacture Nos. 25 to 37 are Comparative Examples in which the manufacturing conditions were deviated from a desired range, and thus any one or both of the structure observed by using the optical microscope and the ratio of the grains having the intragranular orientation difference in a range of 5° to 14° did not satisfy the range of the present invention. In these examples, the stretch flangeability did not satisfy the target value.

In addition, in some examples, the tensile strength was also deteriorated.

INDUSTRIAL APPLICABILITY

According to the present invention, it is possible to provide an inexpensive high-strength hot-rolled steel sheet which is excellent in the stretch flangeability and can be applied to a member which requires high strength and the strict stretch flangeability. The steel sheet contributes to improving fuel economy of vehicles, and thus has high industrial applicability.

What is claimed is:

1. A hot-rolled steel sheet comprising, as a chemical composition, by mass %, C: 0.020% to 0.070%,
Si: 0.10% to 1.70%,
Mn: 0.60% to 2.50%,
Al: 0.01% to 1.00%,
Ti: 0.015% to 0.170%,
Nb: 0.005% to 0.050%,
Cr: 0% to 1.0%,
B: 0% to 0.10%,
Mo: 0% to 1.0%
Cu: 0% to 2.0%,
Ni: 0% to 2.0%,
Mg: 0% to 0.05%,
REM: 0% to 0.05%,
Ca: 0% to 0.05%,
Zr: 0% to 0.05%, P: limited to equal to or less than 0.05%, S: limited to equal to or less than 0.010%, and N: limited to equal to or less than 0.0060%, with the remainder of Fe and impurities;

wherein a structure includes, by area ratio, a ferrite in a range of 5% to 60% and a bainite in a range of 30% to 95%, wherein a tensile strength of the steel is equal to or greater than 590 MPa, and a product of the tensile strength and a limit forming height in a saddle type stretch flange test is equal to or greater than 19500 mm·Mpa, and wherein in the structure, in a case where a boundary having an orientation difference of equal to or greater than 15° is defined as a grain boundary, and an area which is surrounded by the grain boundary and has an equivalent circle diameter of equal to or greater than 0.3 μm is defined as a grain, an area ratio of grains having an intragranular orientation difference in a range of 5-14° to total amount of grains is 20% to 100%.

2. The hot-rolled steel sheet according to claim 1, wherein the chemical composition contains, by mass %, one or more selected from Cr: 0.05% to 1.0%, and B: 0.0005% to 0.10%.

3. The hot-rolled steel sheet according to claim 1, wherein the chemical composition contains, by mass %, one or more selected from Mo: 0.01% to 1.0%, Cu: 0.01% to 2.0%, and Ni: 0.01% to 2.0%.

4. The hot-rolled steel sheet according to claim 1, wherein the chemical composition contains, by mass %, one or more selected from Ca: 0.0001% to 0.05%, Mg: 0.0001% to 0.05%, Zr: 0.0001% to 0.05%, and REM: 0.0001% to 0.05%.

* * * * *